United States Patent [19]

Bakalov et al.

[11] Patent Number: 4,703,493

[45] Date of Patent: Oct. 27, 1987

[54] SEAL FOR AN ELECTRODE HOLE IN AN ELECTRIC ARC FURNACE

[75] Inventors: Nikolay G. Bakalov; Penyo I. Penev; Ivan K. Ivanov; Velyo T. Velev; Peter H. Savov; Alexander Y. Vulchev, all of Sofia, Bulgaria

[73] Assignee: Npp Po Elektrotermia, Sofia, Bulgaria

[21] Appl. No.: 892,943

[22] Filed: Aug. 4, 1986

[51] Int. Cl.[4] ..... H05B 7/12

[52] U.S. Cl. ..... 373/95

[58] Field of Search ..... 373/94, 95, 96, 100, 373/101

[56] References Cited

U.S. PATENT DOCUMENTS 4,517,678 5/1985 Ball et al. ..... 373/95

4,587,658 5/1986 Ball et al. ..... 373/95

*Primary Examiner*—Roy N. Envall, Jr.

*Attorney, Agent, or Firm*—Karl F. Ross; Herbert Dubno

[57] ABSTRACT

A sealing device which comprises a refractory portion consisting of high-alumina material with an $Al_2O_3$ content higher than 80%. The internal portion of the sealing device is made up of refractory cement with an $Al_2O_3$ content higher than 80% which is cast and vibrated in a mould formed by a cylinder-shaped metallic part of the device and an internal fixed template. After the setting of the refractory cement, the internal templet is drawn out and the device, comprising a metallic and a refractory portion, is subjected to drying. This is effected at 150° C.

5 Claims, 4 Drawing Figures

SEAL FOR AN ELECTRODE HOLE IN AN ELECTRIC ARC FURNACE

FIELD OF THE INVENTION

This invention relates to a seal for an electrode hole in an electric arc furnace.

BACKGROUND OF THE INVENTION

Furnace gases can flow out through the electrode holes in the roof of an electric arc furnace. When a fourth hole is provided in the roof, problem of flow through an electrode hole is alleviated, but is not solved. The furnace gases can generate flames, which sometimes reach a height of two or more meters. The overflowing gases always contain solid particles of iron oxides and calcium oxides (lime).

The problem of sealing the electrode holes arose with the development of the first electric arc furnaces at the beginning of this century. Different sealing devices have been suggested. All these devices only reduce more or less the outflow of furnace gases, but do not fully prevent it. Despite this drawback, many electric furnaces presently use different designs of such sealing devices.

During the 1970's the wide spread use of sealing devices which operate on the "air cushion" principle commenced. These devices form an annular chamber around the electrode into which such a quantity of air is blown that, during the air outflow upwardly along the electrode, there is maintained in the chamber a pressure slightly higher than that inside the furnace space, i.e. about 3 mm water column. Such sealing devices are made of metal without or with water cooling or of an extremely metallic and an internally refractory chamotte portion. The metallic devices without water cooling are simple to manufacture and seal well, but their life is limited because of deformations and an the increase of the internal hole size. The metallic devices with water cooling are more complicated to manufacture and are more expensive, but they have a life which is several times longer life.

There have been suggested sealing devices of the same type which are provided with an internal chamotte refractory. These devices have a substantial drawback due to the relatively low fire-resistance of the chamotte materials. Depending on their chemical composition, they soften at about 1500° C. As a result, during operation their internal hole size increases gradually; this impairs or even terminates the sealing action.

All known sealing devices operating on the "air cushion" principle are provided for the air delivering with a duct-diffuser with a nozzle along the duct axis. Gas is delivered under pressure through this nozzle. This gas flow entrains in the duct-diffuser a several times greater air volume from the atmosphere. Through a hole in the side wall of the device, the gas-air flow enters the chamber around the electrode and effectively blocks totally the outflow of furnace gases.

According to the specific conditions in a given plant, the pressurized gas can be compressed air, steam, waste industrial nitrogen, or another similar gas. The choice of the pressurized gas is determined by economic considerations. The composition of the gas does not influence the sealing action.

During the last ten years electric arc steelmaking furnaces have undergone many improvements and this has resulted in an increase of their output by two to three times. The endurance of the sealing devices is directly related to the use of water-cooled roofs, to the sharply increased secondary voltage of the transformers, and the pneumatic transport and injection of alloying and slag-forming materials. The metallic sealing devices cannot endure for a sufficiently long time such heavy-duty conditions and, because of the comparatively frequenct arcing by momentary powerful electric arcs between the sealing devices of two adjacent electrical-supply phases, they are quickly damaged. The failure of the sealing devices with internal chamotte bodies occurs very fast because of the insufficient fire-resistance of the chamotte material.

OBJECT OF THE INVENTION

It is therefore the object of this invention to provide a sealing device for an electrode hole, comprising an internal portion of a material of high fire resistance which can sustain the heavy-duty conditions of a modern electric furnaces and whose, at that, refractory portion can be fabricated easily and should not require heating up to very high temperatures as in the case of chamotte refractories, for example.

SUMMARY OF THE INVENTION

This object is achieved, according to the invention, with a seal having a refractory portion of the sealing device which consists of a high-alumina material with an $Al_2O_3$ content higher than 80%. The internal portion of the sealing device is thus made up of refractory cement with an $Al_2O_3$ content higher than 80% which is cast and vibrated in a mold formed by the cylinder-shaped metallic part of the device and an internal fixed pattern or form. After the setting of the refractory cement, the internal pattern or form is drawn out and the device, comprising a metallic and a refractory portion, is subjected to drying. This is effected at 150° C., but it is possible for the temperature to reach 220° C. During the drying the moisture is totally removed, but the hydrate bond of the cement is not destroyed.

In another modification the aforementioned mold is filled and compacted in a known way with a high-alumina ramming mass with an $Al_2O_3$ content higher than 85%. The primary materials for preparing the mass can be white corundum 75–85% and kaolin 15–25% and this mixture contains as a bonding agent phosphoris acid and/or phosphate compounds in a quantity of 5 to 15% with respect to the solid materials. For this purpose there are usually used suitable ready rammming masses produced by the refractory plants. After the compacting of the refractory portion and its setting, the internal pattern is drawn out and the device is subjected to drying at 150° C. (or up to 220° C.). Thus the moisture and eventually present low-volatile components are removed, but the constitution water of the chemical bond between the solid refractory grains is not removed.

For improving the mechanical strength of the high-alumina cement or the high-alumina ramming mass, we can provide a so-called micro-reinforcement. During the preparation of the cement or the ramming mass, there are added short wires with a diameter of from 0.3 to 2.0 mm and a length of from 10 to 40 mm in a quantity of 0.5 to 6% with respect to the weight of the high-alumina material. This wires are of carbon steel or of stainless chrome-nickel steel. It is also possible to use wires of other suitable metals or alloys.

In both cases of manufacture, the sealing device is provided in the zone of the chamber with one or more side holes intended for the inlet of a flow of air or gas-air mixture, and this flow maintains the necessary pressure in the chamber and does not allow any outflow of furnace gases.

From a practical point of view, the delivery of the gas-air mixture through one hole in the chamber is more favourable. Normally the known tangential delivery of the gas-air flow is used. It is also possible to direct radially the flow by using a deflector-distributor which distributes the flow into both halves of the chamber. The deflector-distributor is made of metal or of a refractory material. From a practical point of view in the majority of cases there is preferred the tangential delivery.

In the case of a cylindrical shape of the external metallic member and the refractory internal portion of the chamber and a coincidence of their axes, the thickness and the mechanical strength of the refractory portion in the zone of the delivery hole for the gas flow are reduced. Moreover, in the case of a cylindrical shape of the chamber a uniform pressure distribution is not achieved. Therefoere, the shape of the chamber as seen from above (i.e. in cross section) is preferably not a circle but an Archimedean spiral, and the chamber is therefore called "a spiral-shaped chamber".

The zone of the inlet hole for the gas-air flow is reinforced mechanically by an external boss of the metallic shell and the refractory lining of the sealing device, which increases the thickness and strengthens the refractory portion.

A further thickness increase of the refractory portion in this zone is achieved by displacing the axis of the spiral-shaped chamber with respect to the axis of the metallic cylinder-shaped enclosure in a direction opposite and almost perpendicular to the inlet hole for the gas-air flow.

In the most general case, the sealing device consists of three members: a top member and a bottom member with round holes through which the electrode passes, and a central member with the spiral-shaped chamber and a hole for the lateral and generally tangential inlet of the gas-air flow. These there members can be manufactured separately and are then additionally connected in an appropriate manner. It is also possible to manufacture the three members jointly; in this case the sealing device has a common metallic enclosure and an integral refractory body.

In many cases it is preferable to manufacture the top and the central spiral-shaped members simultaneously as one body. In the case that a smooth surface is provided by the refractory bricks forming the holes for electrodes in the roof, there is no need for practically a bottom member of the sealing device. In such cases the device sits directly upon the refractory masonry of the roof, this masonry replacing the bottom member of the device. In some modifications of the roof masonry, this solution is not possible. The bottom member is then manufactured separately consists of the aforedescribed metallic and refractory portions. The connection of this bottom member with the top member, which represents an integral body of spiral-shaped part with a hole for the gas-air flow and a top member with cylindrical electrode hole, is effected in an appropriate way.

It has already been mentioned that the necessary gas-air mixture for the sealing device is produced in a known way in the injector, which consists of a cylindrical duct-diffuser and an externally mounted nozzle for the delivery of pressurized gas. The nozzle is disposed along the axis of the gas feed duct.

BRIEF DESCRIPTION OF THE DRAWING

The invention will now be described by way of example with reference to the accompanying diagrammatic drawing in which.

SPECIFIC DESCRIPTION

Figure 1:
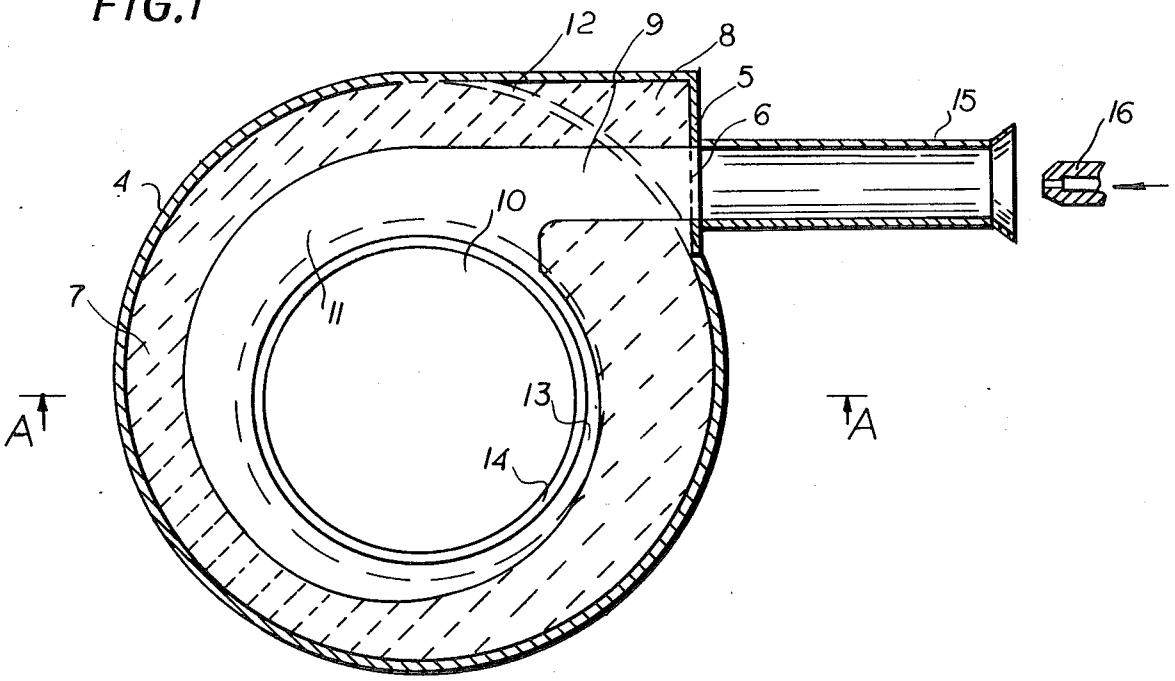
FIG. 1 is a plan view in section of the sealing device along the axis of the side passageway, the section being taken through the duct for tangential delivery of the gas-air flow.
Figure 2:
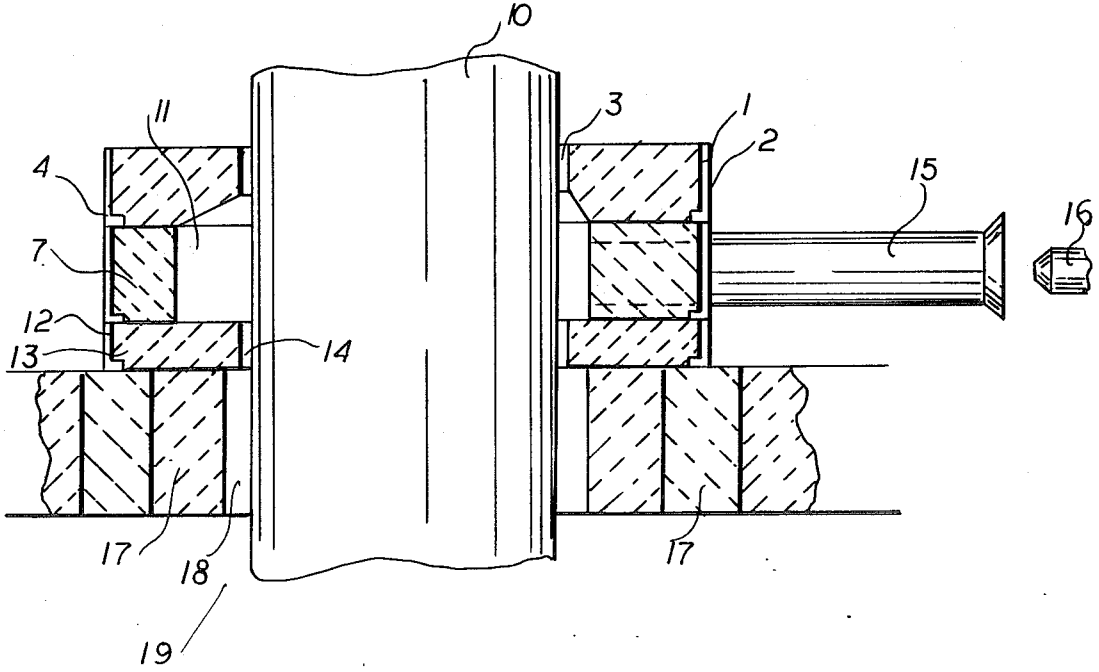
FIG. 2 is a section along line A—A of FIG. 1.

The sealing device illustrated in FIGS. 1 and 2 consists of three members: a top member 12 and a bottom member 12, 13 of cylindrical shape an with cylindrical holes 3, 18, which are coaxial with the electrode 10, and a central member 7 whose chamber 11 has its displaced with respect to the axis of the cylindrical metallic enclosure in a direction opposite and almost perpendicular to the inlet duct for the gas-air flow.

The central member of the sealing device, forming the spiral-shaped chamber 11, has a metallic 5 and a refractory 8 boss in the zone of the side passageway 9 for the passage of the gas-air flow. The axis of then refractory spiral-shaped part 7 is displaced with respect to the cylindrically-shaped metallic part 4 in the same way as the top 2 and the bottom 13 refractory parts and coincides with their axis.

As illustrated in FIGS. 1 and 2, the top member of the sealing device consists of a cylindrical metallic enclosure 1 and and internal refractory part 2 with cylindrical hole 3 for the passage of the electrode.

The central member of the sealing device consists of a cylindrically-shaped metallic enclosure 4 with metallic boss 5 in the zone of the hole 6 for connection with the duct-diffuser 15. The spiral-shaped high-alumina part 7 has an external boss 8 formed with a side passageway 9, provided for the passage of the gas-air flow. The internal wall of the refractory part 7 forms around the graphite electrode 10 the spiral-shaped chamber 11.

The bottom member of the sealing device consists, like the top member, of a cylindrical metallic enclosure 12 and a refractory part 13 with a cylindrical hole 14.

The refractory parts 2, 7, 8 and 13 consist of refractory materials with a content of $Al_2O_3$ higher than 80%. They are made by casting and vibrating high-alumina cement or by compacting high-alumina ramming mass in molds formed by the metallic enclosures 1, 4 and 5, 12 and internal fixed forms. After the setting of the refractory cement or of the refractory ramming mass, the forms are drawn out and the three members of the device, consisting of metallic 1, 4 and 5, 12 and refractory 2, 7 and 8, 13 parts are dried at a temperature of 150° C. During the drying the moisture and any highly volatile components are evaporated but the constitution water of the chemical bond of the ramming mass is not removed.

The sealing device is provided with a duct-diffuser 15 with a nozzle 16, intended for the delivery of pressurized gas. They are manufactured of metal.

After the manufacture of the three members of the device, they are connected together in an appropriate way and the axes of the refractory parts 2, 7 and 8, 13 coincide.

The sealing device can act upon refractory bricks 17, which enclose the electrode hole 18 in the furnace roof.

The operation of this sealing device is the same as of that disclosed in earlier patents: The gas-air flow, formed in the duct-diffuser 15, passes through the hole 6 and the duct 10 and enters the spiral-shaped chamber 11. During the outflow of the gas almost exclusively through the annular gap 3, formed between the refractory part 2 and the graphite electrode 10, there is maintained in the chamber 11 a pressure which is slightly higher than the pressure in the top part of the furnace space 19.

Figure 3:
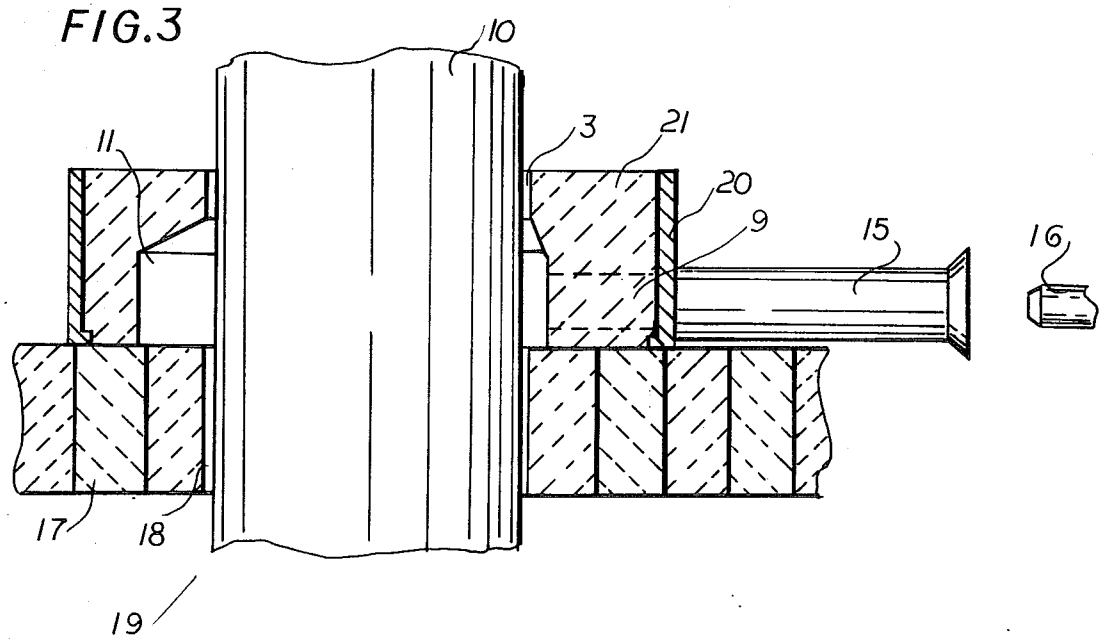
FIG. 3 is a side elevation in section of the sealing device with tangential delivery of the gas-air flow, which consists of a common top and central member the role of the bottom member being effected by the roof masonry.

The sealing device according to FIG. 3 consists of a top and a central member, which form an integral body. They have a common metallic enclosure 20 and a common refractory portion 21. The sealing device seats directly upon the refractory bricks 17 which enclose the electrode hole 18 in the furnace roof.

In this modification there is no separate bottom member of the device the function of a bottom member is performed by the ring of refractory bricks 17 which enclose the electrode hole 18 in the furnace roof. The numerals used in FIG. 3 for the other parts of the device are the same as those used in FIG. 2.

Figure 4:
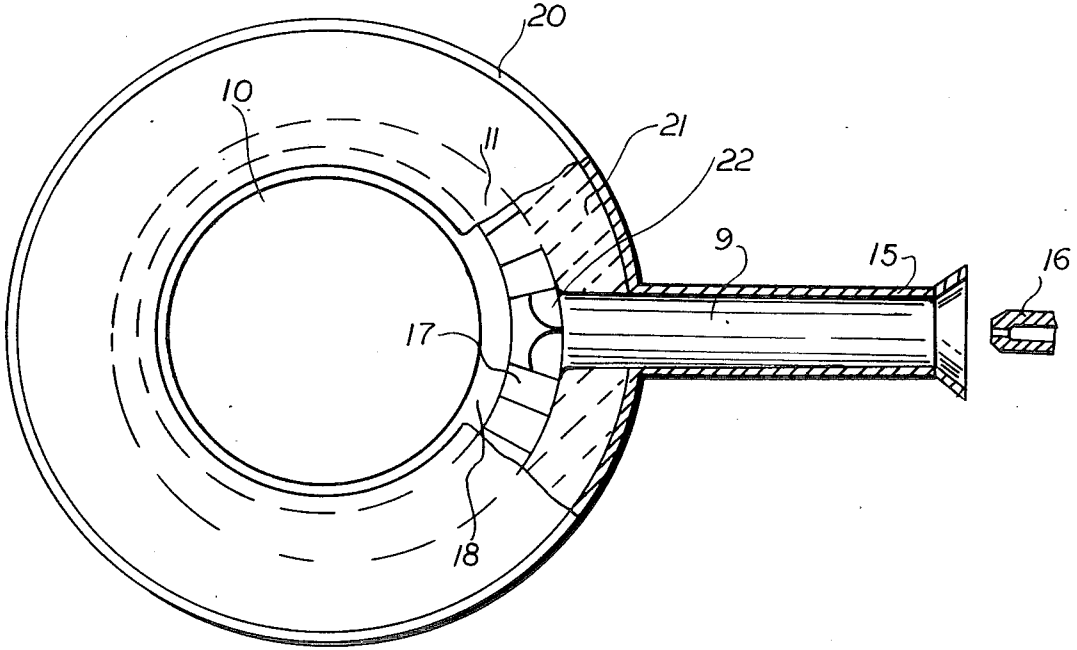
FIG. 4 is a plan view of the sealing device with radial delivery of the gas-air flow, which consists of a common top and central member—without a bottom member; showing a partial cross-section along the side passageway.

The sealing device shown in FIG. 4 is with radial delivery of the gas flow. Shown is a plan view partial cross-section along the axis of the passageway 9. As the device shown in FIG. 3, this device has also a common metallic enclosure 20 and a common refractory portion 21. Here the refractory portion 21 is formed by the two inverse spiral-shaped half-chambers 11. A new member is only the metallic deflector-distributor 22 for the gas flow. The numerals denoting in FIG. 4 the other parts of the device are the same as in FIG. 1.

A substantial advantage of the sealing device according to the invention is, that its internal portion consists of high-alumina refractory which has a fire-resistance higher than 1800° C., or by 250°-300° C. higher than that of the chamotte refractories. Namely this fire-resistance which is higher by 250°-300° C. is of decisive importance for the successful use of the disclosed sealing device for steelmaking electric arc furnaces. This property determines a good endurance of the sealing device, from where follows the reliable electrical insulation between the devices of the electrodes of adjacent phases. Even if, because of the deposition of electroconductive powder on the furnace roof, there occurs a momentary powerful arc between the two adjacent sealing devices, this does not result in objectionable consequences. The result is only a small melted spot in the metallic enclosure which, generally, does not influence the sealing action.

The high fire-resistance of the sealing device does not permit any sticking of solid particles carried by the furnace gases. If, nevertheless, in certain cases there are formed internal deposits mainly of slag drops, their adhesion to the refractory of the device is only mechanical and they can be easily removed.

The good endurance of the sealing device results in a prolonged utilization of the advantages of good sealing: an increased endurance of the furnace roof, a substantial improvement of the conditions of operation of the electrode holder heads, a possibility for control of the pressure within the furnace space with all related favourable consequences, and a considerable reduction of the dust-loading in the steelmaking plants.

A particularly important advantage due to good sealing is the reduction of electrode consumption. This is seen particularly when coated electrodes are used. There is both an increased the endurance of the coating and, secondary consumption by oxidation in the chamber of the sealing device is generally eliminated.

In the case of electrode breakage within the sealing device, there occurs sometimes a short very powerful electrode arc between both parts of the broken electrode column. But this arc cannot generally damage the high-alumina refractory of the sealing device.

An important advantage of the invention is the manufacture of an integral large-size refractory body of high-alumina cement or of high-alumina ramming mass and, in this case, a baking at a temperature of 1350°-1400° C. is not required as in the case of the chamotte refractory materials, while only a drying at a temperature of 150° C. is necessary.

We claim:

1. A sealing device for a hole in a roof of an electric furnace adapted to be traversed by an electrode, said device comprising:

an annular central body comprised of a metal shell, and a mass of a high-alumina material with an $Al_2O_3$ content in excess of 80% and selected from the group which consists of a refractory cement with an $Al_2O_3$ content in excess of 80% cast and vibrated into said shell and dried therein at a temperature of substantially 150° C. to 220° C., and a high-alumina ramming mass together with a phosphoric acid or phosphate compound binder compacted into said shell and dried therein at a temperaure of subsantially 150° C. to 220° C., said mass of high-alumina material defining a chamber with said electrode above said roof and being formed with a laterally projecting boss provided with a lateral passage communicating with said chamber;

an annular cover body closing the top of said chamber, defining an annular gap with said electrode such that a gas fed to said chamber passes out of said gap while maintaining a pressure in said chamber sufficient to block passage of furnace gas through said hole, and comprised of a metal shell, and a mass of a high-alumina material with an $Al_2O_3$ content in excess of 80% and selected from the group which consists of a refractory cement with an $Al_2O_3$ content in excess of 80% cast and vibrated into said shell of said cover body and dried therein at a temperature of substantially 150° C. to 220° C., and a high-alumina ramming mass together with a phosphoric acid or phosphate compound binder compacted into said shell of said cover body and dried therein at a temperature of substantially 150° C. to 220° C.; and a metal duct communicating with said passage and terminating at boss of said high-alumina material of said central body for supplying the gas fed to said chamber to said passage.

2. The sealing device defined in claim 1, further comprising an annular bottom body surrounding said electrode and interposed between said central body and said roof, said annular bottom body being comprised of a metal shell, and a mass of alumina with an $Al_2O_3$ content in excess of 80% and selected from the group which consists of a refractory cement with an $Al_2O_3$ content in excess of 80% cast and vibrated into said shell of said cover body and dried therein at a temperature of substantially 150° C. to 220° C., and a high-alumina ramming mass together with a phosphoric acid or phosphate compound binder compacted into said shell of said bottom body and dried therein at a temperature of substantially 150° C. to 220° C.

3. The sealing device defined in claim 1 wherein said shells of said bodies are formed in one piece and said masses of high-alumina material of said bodies are formed in one piece.

4. The sealing device defined in claim 1 wherein said passage opens readily into said chamber.

5. The sealing device defined in claim 1 wherein said chamber is formed spirally around said electrode and said passage opens tangentially into said chamber.

* * * * *